US008186364B2

(12) United States Patent
Silva

(10) Patent No.: US 8,186,364 B2
(45) **Date of Patent: *May 29, 2012**

(54) HANDLE FREE CLAW CLIP

(76) Inventor: David Alan Silva, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/715,629

(22) Filed: Mar. 8, 2007

(65) Prior Publication Data

US 2008/0216862 A1 Sep. 11, 2008

(51) Int. Cl.
*A45D 8/00* (2006.01)

(52) U.S. Cl. ..... 132/275; 132/276

(58) Field of Classification Search ..... 132/273, 132/275–284, 200; D28/10, 39, 40, 41, 42, D28/43; 2/207

See application file for complete search history.

(56) References Cited

U.S. PATENT DOCUMENTS 5,690,128 A * 11/1997 Grimes ..... 132/128
5,826,593 A * 10/1998 Haubrich ..... 132/128
5,975,092 A * 11/1999 Tsai ..... 132/275
6,135,125 A * 10/2000 Sartena ..... 132/275
6,302,115 B1 * 10/2001 Sartena ..... 132/53
2002/0170569 A1 * 11/2002 Silva ..... 132/277
2004/0149306 A1 * 8/2004 Rogers ..... 132/277
2006/0219255 A1 * 10/2006 Coral et al. ..... 132/277
2007/0131239 A1 * 6/2007 Harrison et al. ..... 132/277
2007/0239539 A1 * 10/2007 King et al. ..... 705/14
2008/0257371 A1 * 10/2008 Silva ..... 132/210

* cited by examiner

*Primary Examiner* — Todd Manahan
*Assistant Examiner* — Brianne O'Neill

(57) ABSTRACT

A hair clip that opens and closes using an elastic band. The band holds the jaws in an open position (which eliminates the need for the levers) and the band also urges the jaws together to close the clip (eliminating the need for a metal spring). The clip has a length of material that is attached either across its top or around it. Because the jaws have no attached protruding levers for opening and closing them (like the ones in a traditional 'butterfly' clip), the length of material lays relatively smooth across the top of the clip, which not only hides the hinge and elastic band (improving the aesthetic appearance of the clip), it makes it possible to decorated the material or add a companies logo thereto.

2 Claims, 3 Drawing Sheets

HANDLE FREE CLAW CLIP

FIELD OF THE INVENTION

The present invention relates to a hair fastener. More particularly a claw clip comprising attached and pivotable jaws that open and close without the use of springs or levers. It opens and closes by using a unique banded technology. Further, it has an outer covering that hides both the clip hinge and band while creating a smooth and visually appealing surface.

BACKGROUND OF THE INVENTION

One type of prior art clips, which use pivotable jaws, are generally known as butterfly clips. These clips comprise two concave jaw members having tines and being joined along a pivot axis or hinge. A metal spring arrangement is provided at the pivot axis to resiliently urge the tines of the jaws to a closed position to grip the hair. To enable the tines to be disengaged and the jaws opened, the jaws are provided with lever members (some times called arms or handles) extending there from at a position away from the tines. This gives the clip the classic butterfly appearance and hence its common name. When the clips are worn, the primary visible parts are the lever members, the hinge, and the spring mechanism. The problem is that although these clips are easy to use, the spring, hinge and lever members are not very aesthetically appealing, especially the levers because they protrude. Another problem is that the jaws don't open very wide, thus not grabbing enough hair, because the lever members run into each other when pinched together. Further, the user has to continuously hold the levers pinched together to keep the jaws open, until the user's hairstyle is in place.

It is thus an object of the present invention to provide an improved hair clip that overcomes the deficiencies in the 'butterfly' clip.

SUMMARY OF THE PRESENT INVENTION

The current invention does not use protruding levers to open the jaws. The jaws of the current invention open by simply spreading them apart until they lock open, and the jaws close by simply squeezing them back together. The current invention also eliminates the metal spring arrangement of the 'butterfly' clip. In the current invention the levers and spring are eliminated because each jaw has an elastic band attached from one arm to the other. The band holds the jaws in an open position (which eliminates the need for the levers) and the band also urges the jaws together to close the clip (eliminating the need for a metal spring). The band is secured to one side of the clip, pulled tight, and secured to the second side. When the jaws are spread open, the band stretches and until the jaws are completely spread apart, the jaws continue to spring back together toward each other when released. However, when the jaws are opened wide the band no longer pulls the jaws back together, the band tension reverses to the opposite direction and holds them apart in a locked open position.

It is important that the band has enough tension to open and close the jaws, and enough stretch to be able to pull the jaws widely apart.

An object of the present invention is to provide an instrument, which is convenient, practical, and inexpensive for use in hair styling.

A further object is to provide an instrument that will keep a hair clip locked open without the use of levers or without having to physically hold it open.

A further object is to provide a hair clip that opens wider than a 'butterfly clip' due to the eliminated protruding levers, which makes more room for the jaws to open wider.

A further object is to provide such an instrument that holds tighter than a traditional claw clip.

A further object is to provide an instrument that can be reused over and over again.

A further object is to provide an instrument that will quickly hold the user's hair up in a neatly secured style.

A further object is to provide a hair clip with an outer covering that hides the clip hinge, band and most the clip, while creating a sleek and visually appealing surface.

A further object is to provide a hair clip that has an outer material covering with a sleek and visually appealing surface that acts as a canvas for decorations, including embroidered or iron-on patterns, images, or logos.

According to the preferred embodiment of the present invention, there is provided a hair clip comprising two arced jaw members having tines and is joined along a pivot axis creating a hinge. There are one or more elastic bands attached from the inside of one jaw to the other. There are many ways the bands could be attached to each jaw, however, the common thing in all of them is that the band is always secured to one jaw, pulled until tight, and then secured to the second jaw. Because the band is substantially within the inside of the clip, it partially fills in the empty space inside the clip when in a closed position, which allows the band to push against the users hair, creating more hold than a traditional clip, and because the band is resilient it adjusts to different size hair sections. It does this because when the hair section is large it presses the band toward the back of the clips inside. When the hair section is small the band pushes against it. Either way the band pushes against the hair section creating extra hold. The band in the preferred embodiment is laced from one jaw to the other jaw, back and forth through holes along the jaws, and the ends of the band are then tied together. Each jaw has an elongated grove next to, and perpendicular to, the tines. A length of material is attached over the top of the jaws through the grooves, wherein the material substantially hides the hinge and elastic band. The material is either attached by feeding it through the groves and sewing the ends together to create a loop, or secured by a clip, glue or dowel, after each end of the material is fed through the grove. As mentioned above the jaws have no attached protruding levers for opening and closing the jaws (like the ones in a traditional 'butterfly clip'). Having no levers allows for the length of material to lay relatively smooth across the top of the clip, which not only hides the hinge and elastic band (improving the aesthetic appearance of the clip), it makes it possible to decorated the material or add a companies logo thereto.

In use, the current invention is locked opened by spreading apart the jaws from a closed position to an open position. The clip is placed over the hair section that is being secured, and then squeezed slightly to release the band tension to close the clip to the hair section. The current invention can also be clipped to the users wrist to be stored as a bracelet until ready for use in the hair.

In another use, the clip can be locked open, a hair section can be wrapped around the clip center like a roller, and then the clip can be released closed to secure the hair section.

In a second embodiment the jaws can be fed through a tube of material to cover the hinge and band, wherein the material tube ends can be secured to the jaws at the point the tines protrude from the jaw base. This covers the entire clip accept the tines. The material tube ends can be secured by gluing them to the clip where the tines begin or by sewing them to the clip, around the tines. When the clip is attached to the hair this version gives the appearance of material wrapped around the hair section, because the tines hide in the hair while grasping it (leaving only the material showing).

Other objects, features and advantages of the present invention will become apparent from the following description of the preferred embodiments given with reference to the accompanying drawings.

DETAILED DESCRIPTION OF THE PREFERRED EMBODIMENTS

Figure 1:
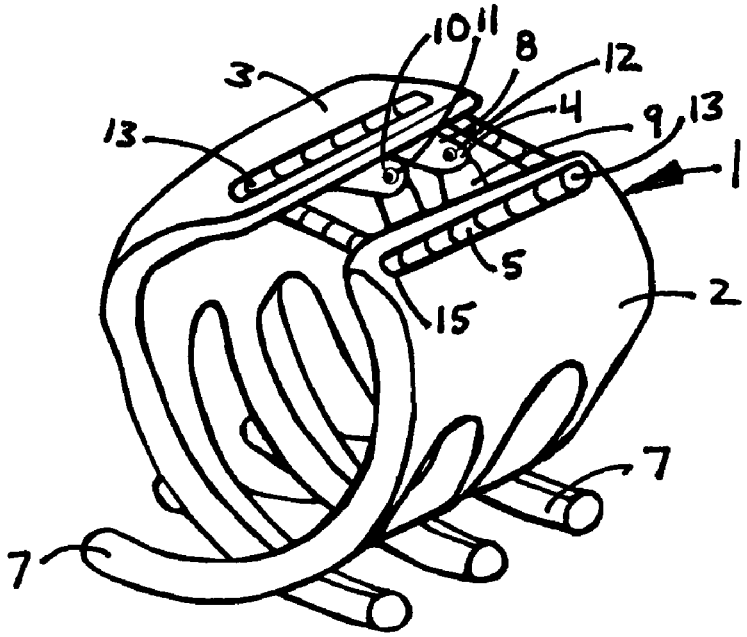
FIG. 1 is a plan view according to the present invention.
Figure 2:
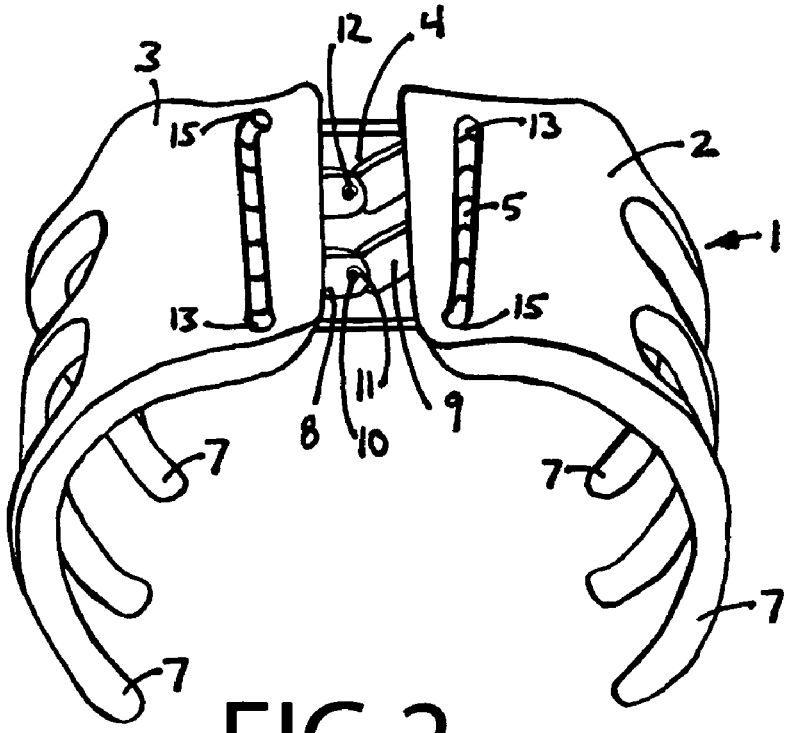
FIG. 2 is a plan view according to the present invention with the jaws locked open.

Referring to FIGS. 1 and 2 of the accompanying drawings, there is illustrated the hair clip embodying the present invention. The clip, generally designated by reference numeral 1 has two jaws 2 and 3 bent in a direction away from the clip pivot 4 in a concave since. Each jaw 1 and 2 has tines 7, and lugs 8 and 9. The lugs 8 and 9 are aligned with a pin 10 placed through holes 11 and 12 in lugs 8 and 9, which create the pivot 4. Wherein the first jaw 2 is secured to the second jaw 3. Preferably the jaws 2 and 3 are made of plastic. An elastic band 5 is attached from the inside of the first jaw 2 to the inside of the second jaw 3. In the preferred embodiment the band 5 is woven through holes 15 and 13 and tied together.

Figure 3:
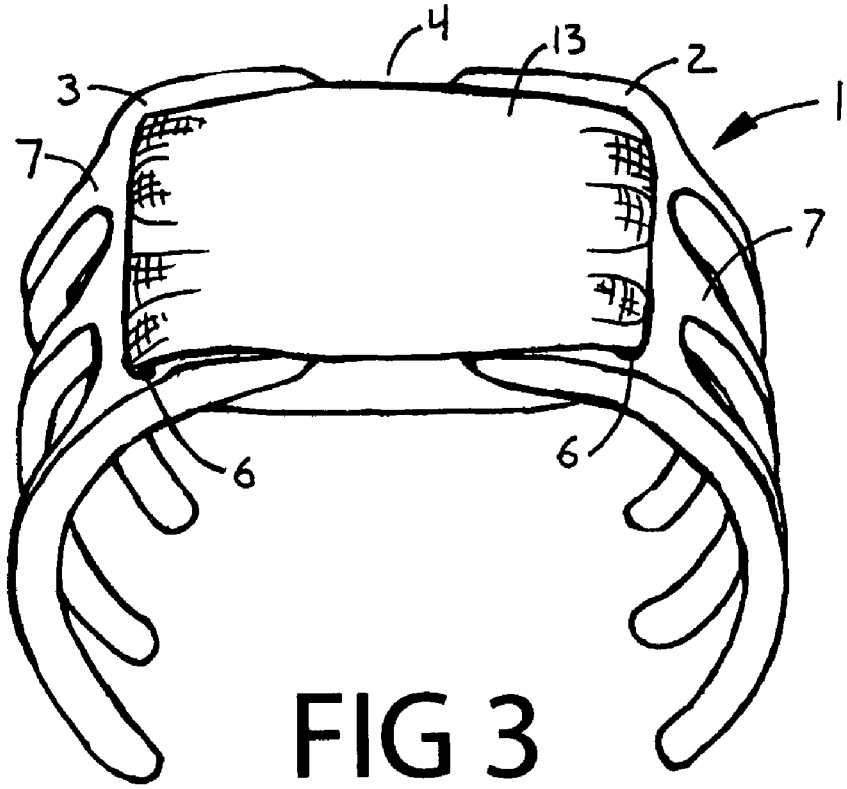
FIG. 3 is a plan view according to the present invention with the jaws locked open and material attached.
Figure 4:
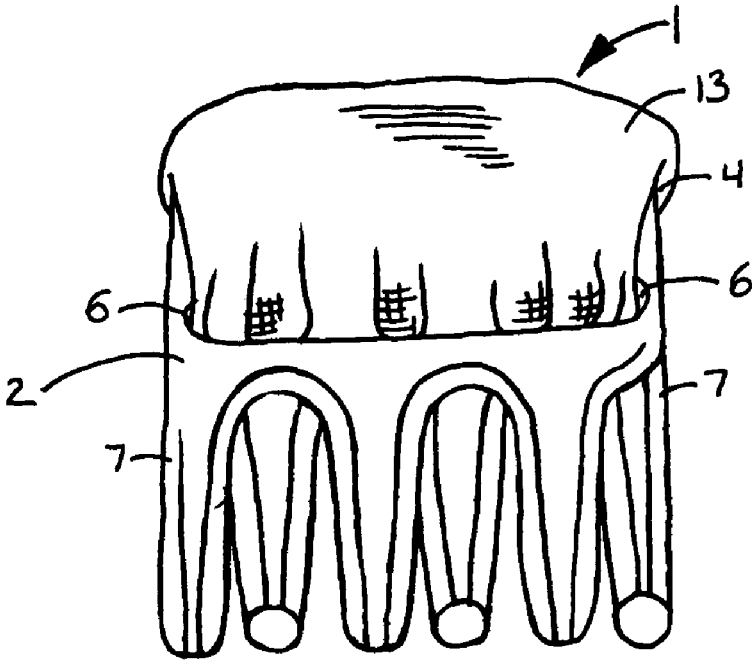
FIG. 4 is a plan view according to the present invention with the jaws closed and material attached.

FIGS. 3 and 4 shows that each jaw 2 and 3 has an elongated grove 6 near the tines 7. Each grove 6 has a length of looped material 13 attached there through.

Figure 5:
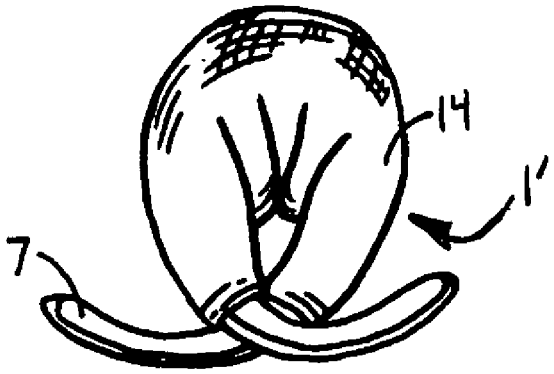
FIG. 5 is a side view of another embodiment of the current invention showing a tube of material wrapped around it.
Figure 6:
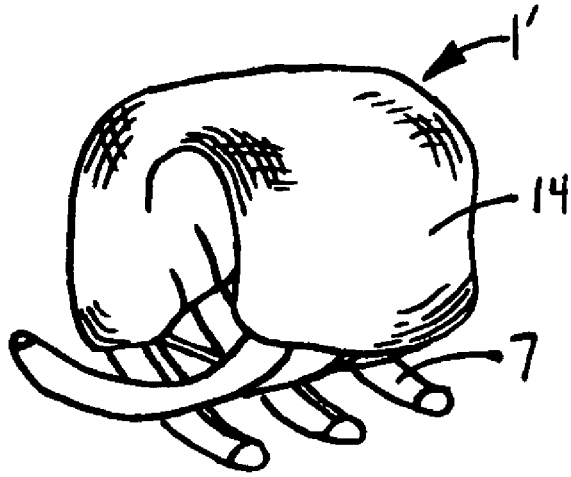
FIG. 6 is a plan view of another embodiment of the current invention showing a tube of material wrapped around it.

FIGS. 5 and 6 shows the clip 1' fed through a tube of material 14 and secured with only the tines 7' showing.

In all of the embodiments described hereinabove the hair clip can be made of any suitable material such as a decorative plastic material, or metal such as gold or silver. The elastic band can be formed of any suitable material that stretches between the jaws to urge the jaws to the closed position and the opened position. The hair clip can be of any size. Also, the material can be false hair attached to the clip in the same manner as the material.

Although the present invention has been described with reference to specific embodiments, it will be apparent to a skilled person in the art that modifications lie within the spirit and scope of the present invention.

What is claimed is:

1. A hair clip comprising:

two arcuate jaws; each jaw having tines at one end and being connected together at an end opposite the tines by a hinge;

at least one elastic band attached to an inside of each jaw, so as to extend there between and urge the tines together so as to grip the hair; wherein when the jaws are spread apart wide enough said band locks said jaws in a spread apart position;

each jaw further including an elongated slot adjacent the end opposite the tines which extends perpendicular to the tines; and a length of material having two ends extending over an outer surface of the jaws and through each of the slots with the ends of the material attached together to form a loop, wherein the loop of material substantially covers the hinge and the at least one elastic band.

2. A hair clip comprising:

two arcuate jaws; each jaw having tines at one end and being connected together at an end opposite the tines by a hinge;

at least one elastic band attached to an inside of each jaw, so as to extend there between and urge the tines together so as to grip the hair; wherein when the jaws are spread apart wide enough said band locks said jaws in a spread apart position;

a tube of material having two open ends; said tube extending from the tines of a respective jaw over the hinge to the tines of the other jaw so as to substantially cover the hinge and the at least one elastic band with the tines of the respective jaw extending outwardly from a respective open end of the tube.

* * * * *